United States Patent [19]

Collett

[11] Patent Number: 5,003,998

[45] Date of Patent: Apr. 2, 1991

[54] METHOD AND APPARATUS FOR CLEANING AND SANITIZING HVAC SYSTEMS

[76] Inventor: Donald H. Collett, 4701 NE. 40th Ave., Vancouver, Wash. 98661

[21] Appl. No.: 341,569

[22] Filed: Apr. 21, 1989

[51] Int. Cl.[5] ..... B08B 5/02

[52] U.S. Cl. ..... 134/22.12; 134/22.18; 134/24; 134/34; 134/36

[58] Field of Search ..... 134/22.1, 22.12, 22.14, 134/24, 34, 36; 210/600

[56] References Cited

U.S. PATENT DOCUMENTS 3,215,560 11/1965 Kredit ..... 134/22.12
3,912,535 10/1975 Rauser ..... 134/22.12
4,141,753 2/1979 Creed ..... 134/22.12
4,508,577 4/1985 Conn et al. ..... 134/22.12

FOREIGN PATENT DOCUMENTS 197710 10/1977 U.S.S.R. ..... 134/22.12

*Primary Examiner*—Asok Pal
*Attorney, Agent, or Firm*—Klarquist, Sparkman, Campbell, Leigh & Whinston

[57] ABSTRACT

Accumulated debris is removed from building ducts by agitating the debris, with a nozzle-headed air hose, as air flows through the ducts. The nozzle has ports arranged so that air jets cause the hose to whip around inside the ducts. A borescope is used to simultaneously monitor progress of the cleaning. Filters are provided over all duct openings to collect debris and prevent it from escaping during cleaning.

18 Claims, 2 Drawing Sheets

METHOD AND APPARATUS FOR CLEANING AND SANITIZING HVAC SYSTEMS

BACKGROUND OF THE INVENTION

1. Field of the Invention

The present invention relates to the removal of accumulated debris in heating, ventilation and air conditioning (HVAC) systems in buildings. In particular, it relates to a method for cleaning debris and biological growth from the inside walls of HVAC ductwork in buildings, including large or tall buildings, without having to disassemble or dismantle the ductwork or other structures behind which the ductwork is situated.

2. General Discussion of the Background

In many commercial and industrial buildings, hospitals, long-term care facilities and other institutional structures, only 10 to 15% of the indoor air is fresh. The remaining portion of the air is actually recirculated stale air. Commercial and institutional buildings provide environments where large numbers of people spend many hours every workday. In many instances, such buildings also house delicate and costly equipment and machinery. As a result, it is important that the air supply in such buildings be kept clean and hygienic.

Heating, ventilation and air conditioning (HVAC) systems are generally responsible for modifying the temperature of and circulating the air in buildings. Modern HVAC systems, if working properly, serve three basic functions: they clean and filter the air in the building, whether the air is fresh or recirculated; they add heat to or remove heat from the air; and they provide temperature regulation and air circulation. Because of these important functions, continuous maintenance of HVAC systems is important. However, most HVAC systems, particularly the ductwork thereof, are rarely inspected, and even more rarely regularly cleaned and disinfected.

Presently, the most common practice of keeping the indoor air supply clean in buildings is the periodic replacement of the HVAC filters, if the HVAC system is equipped with them. However, such practice will not prevent eventual accumulation of debris and biological growth in ductwork, especially over a long period of time. Many HVAC systems, especially in older buildings, lack filters, thereby encouraging more rapid accumulation of debris and biological growth in the ductwork. In either instance, it is important to clean and disinfect the ductwork on a regular basis.

Currently, most HVAC duct systems are cleaned using a specially adapted truck having a large vacuum unit installed thereon. A hose is connected to the vacuum unit and worked through the duct system to remove accumulated debris. Unfortunately, such truck-mounted systems have a number of drawbacks. First, the hoses and attachments thereto are simply too bulky to allow access to many sections of complex ductworks. Also, because the vacuum unit must remain attached to the truck, the method cannot generally be employed above the second or third floor of a building, leaving ductwork in high-rise buildings without any practical method for cleaning. Any suitably large vacuum units that can be detached from a truck are usually too large to transport up and down elevators, consume too much electric power and produce too much noise for use in indoor environments.

Past techniques have also typically required destructive opening of wall, ceiling or floor panels to obtain access for cleaning equipment. And, it has been necessary to cut holes, large enough for a human head, into the duct wall when it is desired to observe the cleaning equipment during use. This has further discouraged duct cleaning.

If HVAC systems in buildings or institutions are not regularly cleaned, not well maintained, or do not function properly as a result of accumulation of debris and biological growth, the occupants, equipment and machinery in the building will eventually be adversely affected. In fact, the recirculated air supply in many buildings is chronically polluted as a result of inadequate HVAC maintenance, a condition known as "Sick Building Syndrome."

Research has shown that moisture incursion into debris-laden ductwork, coupled with a higher-than-normal level of carbon dioxide, a lower level of oxygen, and temperatures within the human comfort zone, create an ideal environment for microbes to flourish. Such biological growth in the ductwork could also lead to populations of health-threatening microorganisms therein, including bacteria, viruses, yeasts and fungi. A recently publicized example is the incidence of Legionnaire's Disease which was linked to microorganism growth in a building's HVAC cooling tower. Large populations of allergy-causing molds and spores are also found in dirty ductwork. Incidents of allergies and chronic respiratory problems experienced by many workers in large buildings are thought to be caused by recirculating air kept in a contaminated state by passing through contaminated ducts.

Hence, there is a need for a method for effectively cleaning debris and biological growth from HVAC ductwork, especially in large or tall buildings. There is also a need for such a method that can be regularly and conveniently performed With minimal disruption of normal activity in the building. Further, there is a need for a method that would allow convenient disinfection of the HVAC ductwork before and/or after such cleaning, the disinfection being performed using chemicals that do not produce obnoxious odors or cause eye or respiratory irritation in nearby personnel. Further, there is a need for such a method that does not require cutting large openings in the ductwork or the destructive opening of walls and panels in order to gain access to the ductwork.

SUMMARY OF THE INVENTION

The present invention is a method and apparatus for cleaning and disinfecting HVAC ductwork, particularly large and complex ductwork systems. The method is simple and convenient to perform and causes minimal disruption of work activity in the building. Further, the ductwork can be cleaned and disinfected without the need for dismantling either the ductwork or other structures such as walls or floors.

To assess the degree of debris accumulation in the ductwork, a fiber-optics borescope may be used to visually examine the entire interior of the ductwork. Before commencing the cleaning steps, the interior of the ductwork, including debris accumulated therein, may be disinfected using a disinfectant aerosol injected into the ductwork. Such disinfection reduces the potential health hazard associated with dislodging and collecting fine debris and flock possibly containing pathogenic microorganisms.

The cleaning method basically includes steps in which the debris is agitated and dislodged from the interior surfaces of the ductwork using an impinging high velocity air stream from a nozzle-ended hose supplied by a portable air compressor. The hose is inserted through an opening in the duct wall and slowly urged to move downstream through the duct as debris is dislodged. During agitation of the nozzle-ended hose, a worker observes the cleaning process through a rigid borescope inserted through the same duct opening as the hose.

When cleaning a return duct, debris-laden air is moved out of the return duct and into a filter by operation of the HVAC unit blower, a particle filter being installed between the return duct and the HVAC unit. To move debris-laden air out of a supply duct and filter the debris from the air, the HVAC unit is likewise operated and, in addition, a portable blower/filter unit is connected to the distal end of the supply duct being cleaned. By employing the HVAC unit and the portable blower/filter unit to clear debris-laden air out of the supply duct, the debris is cleaned out of the entire ductwork using the normal direction of air flow through the ducts.

The nozzle at the end of the air hose is designed so that, when high pressure air is supplied to the nozzle, the hose whips around causing the nozzle to beat off debris without striking the interior walls of the ducts. In particular, the nozzle has a plurality of radial passageways which terminate in orifices that direct jets of air back along the hose at an acute angle to the hose axis. Control of nozzle movement is maintained by adjusting a hand-held regulator that is located between the nozzle and the air source.

Because the method of the present invention employs equipment that is portable and transportable in elevators, it is possible for the first time to regularly clean and disinfect the HVAC ductwork and associated equipment in tall buildings, particularly buildings taller than two to three stories.

A primary object of the present invention is to provide a method of cleaning and disinfecting a complex HVAC ductwork, particularly as found in large or tall buildings, without having to dismantle the ductwork or other structures.

Another object is to provide a method for cleaning and disinfecting such HVAC ductwork without causing significant disruption of normal activity in the building.

Another object is to provide a method for examining the entire ductwork during cleaning without having to cut large inspection ports in the ductwork.

DETAILED DESCRIPTION

The present invention is a method and apparatus for cleaning and disinfecting HVAC ductwork and associated systems, particularly as found in large and/or tall buildings.

As used herein, cleaning refers to the removal of accumulated particulate debris and accompanying biological growth from the interior surfaces of the ductwork; disinfection refers to the application of a disinfectant, or biocidal agent, to the interior surfaces of the ductwork under conditions sufficient to substantially kill biological growth thereon. Disinfection may be performed before and/or after cleaning.

Figure 1:
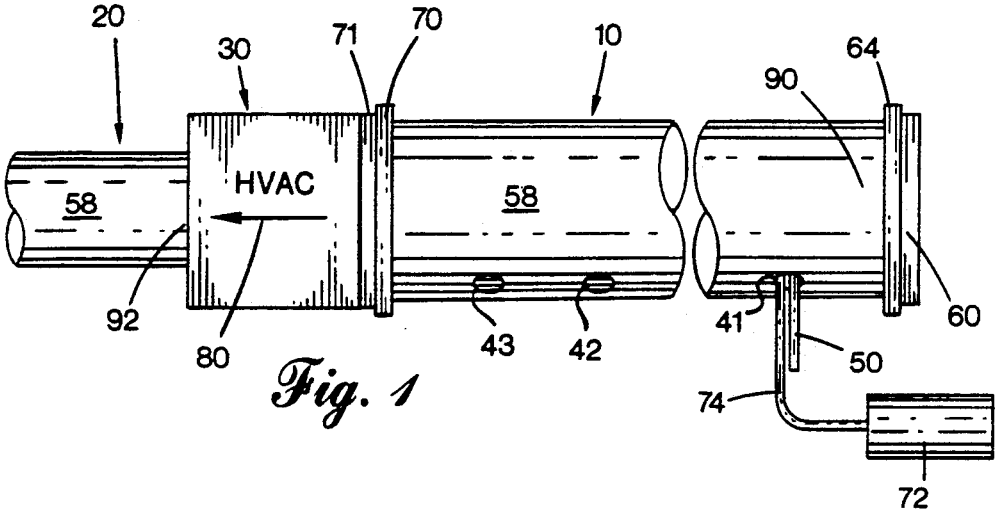
FIGS. 1 and 2 are schematic drawings showing an HVAC unit and associated ductwork with cleaning equipment for performing the process of the present invention.
Figure 2:
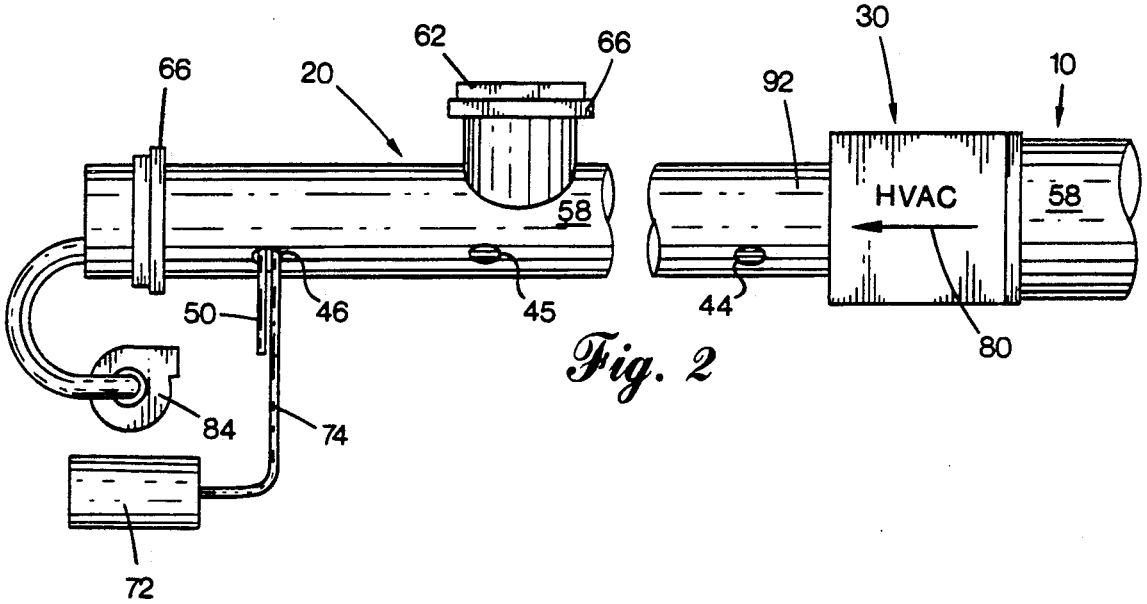

As shown in FIGS. 1 and 2, HVAC ductwork systems are basically of two portions, the return ductwork 10 and the supply ductwork 20. The return ductwork 10 collects and returns room air to the HVAC unit 30 and the supply ductwork 20 distributively conducts air from the HVAC unit 30 to the various rooms. The HVAC unit 30 is an apparatus comprising an air-moving fan or blower which collects air passing through the return ductwork 10 and forces the air to move through the supply ductwork 20 away from the HVAC unit 30, thereby effecting air circulation throughout the building. The HVAC unit 30 may also perform one or more of the following: filtering, heating, cooling, humidifying, dehumidifying, or deodorizing the air passing therethrough.

In most buildings, the ductwork systems are largely hidden from view inside walls, beneath floors, or above ceilings. Only the air intake and outlet registers are generally visible, each of the latter often fitted with a diffuser, an array of blades or fins that divergently spread the air flow exiting the duct into the room. Hidden ductwork can be particularly difficult to inspect, disinfect, and clean, the ductwork often extending substantial distances between floors and between different locations on a particular floor. Hence, before performing the method of the present invention, it is advisable to consult the building's HVAC system blueprints. Even long ducts generally have branches, intake openings, or outlets spaced along their length which would permit access to the duct interior.

In certain instances, to facilitate present and future inspections and cleanings of the ductwork according to the method of the present invention, it is advantageous to punch access holes 41–46 (about 1–2 inches in diameter) spaced at regular intervals along the duct length (about every 20 to 25 feet). Each hole is fitted with a removable cover or cap (not shown). In many instances, inlet or outlet registers are sufficiently regularly spaced along the duct and have sufficiently large openings for gaining access to the duct that access holes are not required.

Prior to beginning the cleaning and disinfection steps of the present method, the HVAC ductwork may be first inspected with a fiber-optics borescope 50. A fiber-optics borescope is basically comprised of a long, thin, flexible fiber-optic element or light pipe connected at the operator end to an eyepiece. The distal end of the fiber-optic element is inserted into the ductwork. The distal end of the fiber-optic element has optical lens properties and is usually also equipped with an integral light source 52 to illuminate the duct lumen and interior duct surfaces during inspection. The operator end of the borescope with the eyepiece may also be equipped with a still camera or video camera to provide a permanent record of the inspection.

As used herein, the duct lumen 56 is the longitudinally extended interior space defined by the walls 58 of the duct that surround the space.

The HVAC unit 30 should be turned off during inspection of the ductwork. With return ductwork, the inspection should begin at the most distal portion of the duct relative to the HVAC unit, e.g., from hole 41. With supply ductwork, the inspection should begin at the portion of the duct nearest the HVAC unit, e.g., from hole 44. The borescope may be inserted through an access hole at an appropriate location, although any suitable entry port may be used, such as a register or diffuser.

Typically, contaminated ductwork will contain deposits of sediment and flock containing a great variety of dirt, grit, fibers, insect body parts and various microorganisms. The fibers may include hair, fiberglass, textile fibers and asbestos. A great variety of biological growth can be present in such deposits, including molds, yeasts and bacteria. While these organisms are common in the environment and usually non-pathogenic, some are associated with allergic hypersensitivities and present a potentially serious hazard if concentrated in the workplace. Spores of both bacteria and molds can also be present, including those associated with allergies. Inspection using the borescope enables the maintenance person to monitor the condition of the ductwork and accurately locate areas of serious contamination requiring immediate cleaning.

After the visual inspection of the ductwork is complete, if cleaning is indicated, the operator covers with filter material 60, 62 all intake ports 64 and outlet registers 66 of the ductwork to be cleaned. Covering these duct openings prevents accidental discharge of dust-laden air into the room while the ducts are being cleaned. Covering the duct openings also inhibits discharge of disinfectant mists into the room during disinfection of the duct.

According to the present invention, cleaning of the ductwork generally occurs in two stages, where the return ductwork 10 is cleaned first and the corresponding supply ductwork 20 is cleaned second. The method involves agitating and dislodging accumulated debris from the interior of the walls 58 of the ductwork using an impinging pressurized stream of high velocity air and moving the debris-laden air in the normal flow direction through the duct to a filter 70. The high velocity air stream is typically supplied by an air source 72, such as a portable air compressor, through a flexible hose 74 terminated by a nozzle 76. The hose and nozzle are inserted into the duct from an upstream location such as the access hole 41 or register 64 and are urged slowly downstream along the length of the duct. As used herein, downstream refers to the direction, shown by an arrow 80 in FIGS. 1 and 2, parallel to the longitudinal axis of the duct that air normally flows through the duct when the HVAC system is operating; upstream is the direction opposite to the downstream direction. As cleaning progresses, the hose 74 and nozzle 76 may be pulled out of the first access port 41 and threaded into a second, downstream access port 42 in the duct.

To clean the return ductwork, a filter 70 is installed between the ductwork to be cleaned and the HVAC unit, and the blower in the HVAC unit employed to move debris-laden air toward the filter 70. As the air passes through the filter, the debris is trapped by the filter.

To clean the supply ductwork, the HVAC unit is turned off and a portable blower/filter unit 84 is connected to the supply duct 20 at or near the distal end of the duct 20 to be cleaned, as shown in FIG. 2. As used herein, the distal end of a supply duct is the downstream terminus of the duct. Both the HVAC unit 30 and the blower/filter unit 84 are then turned on to transport debris-laden air through the supply ductwork and filter the debris from the air. The blower/filter unit 84 is preferably of a type that can be rolled about to various locations on the building floor, as well as rolled in and out of elevators for transport to other floors. Further, the blower/filter unit 84 should be of a type that can move large volumes of air, such as 4,000 to 6,000 cubic feet/minute (cfm) at a very low noise level to prevent significant disruption of nearby work activity.

Although it is preferable to employ a portable blower/filter unit 84 having a particle filter integral with the blower, it is also possible within the scope of the present invention to employ a separate portable blower unit and portable filter unit, where a filter unit (not shown) is coupled to the duct 20 between the duct and a blower unit (not shown). In either instance, the blower is oriented so as to create a reduced pressure in the duct to which the blower is coupled, causing air in the duct to flow in a normal flow direction through the duct and through the filter situated between the duct 20 and the blower 84. As the air passes through the filter, suspended debris is captured by the filter. Preferably, the filter is an HEPA filter capable of 99.75 percent capture of solids.

To minimize biological contamination of the ambient air in the building during cleaning of the ducts, the ducts may be disinfected before commencing the cleaning steps. Disinfection is performed using a substantially odorless disinfectant having vapors relatively non-toxic and non-irritating to humans, such as glutaraldehyde solution. Other suitable disinfectants may also be used. Disinfectant is injected into the lumen 56 of the duct to be disinfected through access ports or holes, starting at the end 90 most distal to the HVAC unit (return duct) or to the end 92 most distal to the blower/filter unit 84 (supply duct).

Disinfectant is typically injected into the lumen 56 in the form of an aerosol. As used herein, an aerosol is an air suspension of fine liquid droplets or solid particles, more generally of fine liquid droplets, such as a fog or mist. The aerosol is typically generated by a commercially available fogger apparatus, the output nozzle of which is connected to an access port or hole in the duct. To ensure an adequate concentration of disinfectant throughout the ductwork being disinfected, it may be necessary to inject the disinfectant fog at successive downstream access ports along the length of the duct to be disinfected. The aerosol is effective for quickly contacting all interior surfaces of the duct to be cleaned and for penetrating deposits of flock and other debris therein.

If desired or indicated, such disinfection may be performed after the ducts have been cleaned to retard regrowth of organisms.

The following example will illustrate more particular details of a method according to the present invention.

EXAMPLE

This example, with reference to the drawing figures, describes a general method according to the present invention that can be used to clean the return and supply ductwork associated with an HVAC system on a single floor. Typically, the return ductwork is cleaned before the supply ductwork, in keeping with the usual flow direction of air through the ductwork and to minimize re-deposit of debris in just-cleaned ductwork.

Cleaning the return ductwork employs the HVAC system blower to create the requisite pressure drop and air movement through the return ductwork. Such utilization of the HVAC system blower eliminates the need to use an extraneous suction unit.

To begin the procedure, filter medium 60 should be installed in or over each register of the return ducts 10 to be cleaned. For ease of inspection of the ductwork and to allow later insertion of an air nozzle 76 for cleaning the ducts, small access holes 41–43 may be cut as required in the existing return ductwork at intervals of, for example, 20–25 feet. Each access hole is fitted with a cover or plug when not in use to prevent leaks. Such access holes may not be necessary if the ductwork has intake or outlet ports spaced at appropriate distances therealong and the grilles or diffusers covering the ports have sufficiently large openings to permit insertion of the borescope and air hose.

Next, the return ductwork 10 is inspected using the fiber-optics borescope 50 inserted into the duct, starting at or near the most distal inlet register 64 and working toward the HVAC unit 30. All branch ducts from the return trunk duct are similarly inspected, starting at the distal inlet register and working toward the trunk duct. Such inspection will reveal particular locations in the ducts where significant build-up of debris has occurred and where special attention should be focused during the disinfection and cleaning steps.

After inspection is complete, each length of return ductwork 10 may be disinfected as indicated by connecting a disinfectant fogger, such as an electronic atomizer, at or near each corresponding distal inlet register 64. The fogger is left connected to the duct at each distal register only for a time sufficient to achieve satisfactory distribution of the disinfectant on the interior walls of the downstream duct. The disinfectant should be allowed to contact the interior walls of the duct for a time sufficient to achieve satisfactory kill of the biological growth thereon. The length of time required will depend upon the amount of debris deposited on the interior surfaces of the duct and the type and concentration of the disinfectant.

Figure 3:
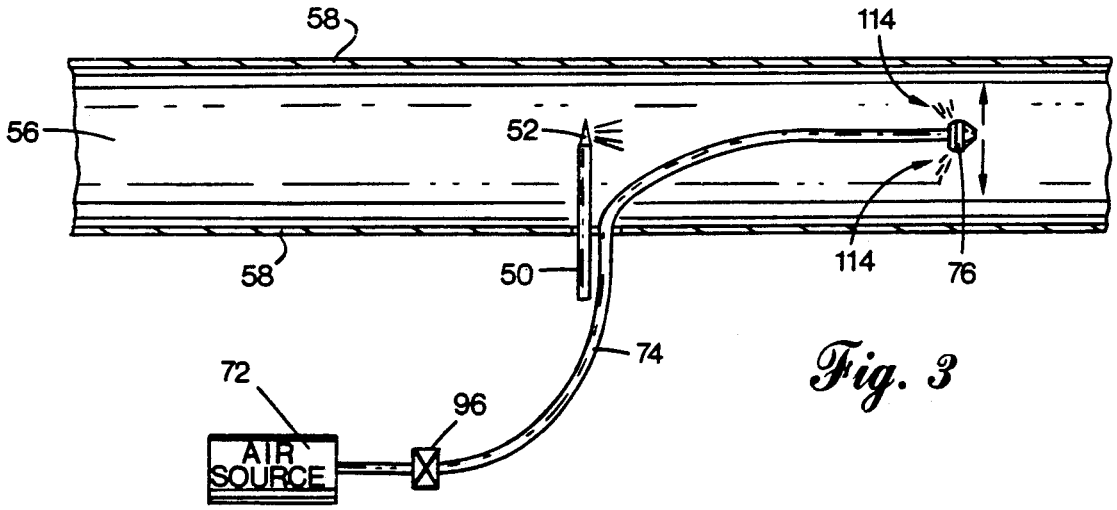
FIG. 3 is a vertical sectional view of a duct during cleaning.
Figure 4:
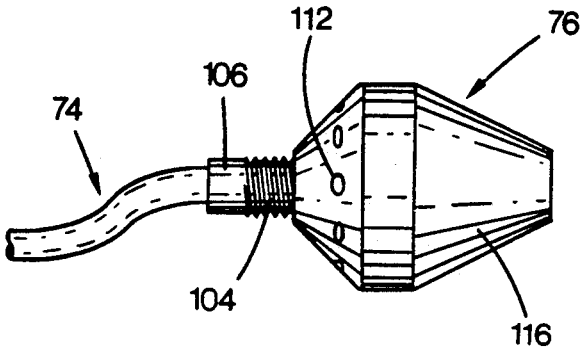
FIG. 4 is a side elevational view of a duct cleaning nozzle according to the present invention with attached air hose.
Figure 6:
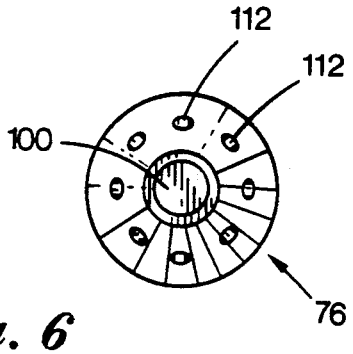
FIG. 6 is a rear elevational view of the nozzle of FIG. 4.
Figure 5:
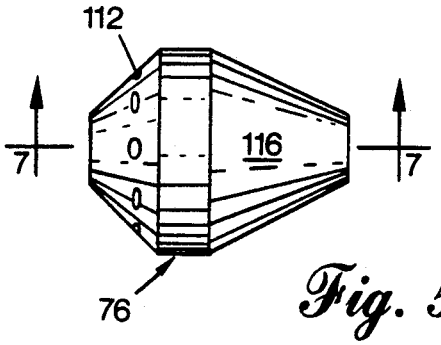
FIG. 5 is a side elevational view of the nozzle of FIG. 4.
Figure 7:
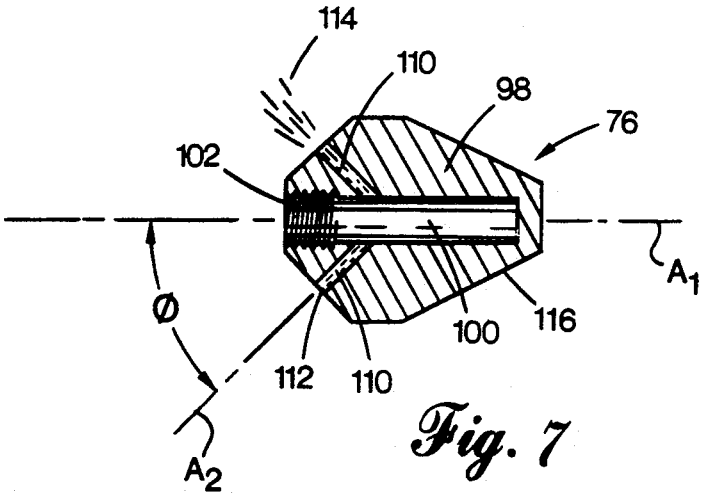
FIG. 7 is a sectional view taken along line 7—7 of FIG. 5.

Next, a debris filter 70 is placed over the existing air filter 71 on the HVAC unit 30. After installing the filter 70, the HVAC unit is turned on. Starting at the distal end of the return ductwork trunk line, a nozzled air hose 74 supplied by a portable air compressor 72 is inserted into the duct through the respective access hole or register as shown in FIG. 3. As the air hose 74 is inserted into and urged through the duct, high velocity air flow through the nozzle 76 agitates and dislodges debris from the interior surfaces of the ductwork and causes the debris to become suspended in the air in the duct. A hand-held regulator 96 is provided between the air source 72 and the nozzle 76 to control the flow of air to the nozzle.

FIGS. 4–7 show views of a nozzle which is particularly suited for cleaning ductwork. The nozzle 76, which can be a body 98 of plastic or metal, has a central bore 100 with a longitudinal axis $A_1$. The wall of the bore 100 is at least partially threaded, the threads 102 mate with threads 104 of a coupling 106 at the end of the hose 74. Extending from the bore 100 is a plurality of passageways 110 terminating in apertures 112 having axes $A_2$. The passageways 110 and apertures 112 are oriented to reverse the direction of air flow so that air jets extend radially from the axis $A_1$ of the bore 100 and fitting 106 and so that the air jets extend back along the hose 74 and at an acute angle $\phi$ to the axis $A_1$. Due to the positioning of the passages 110 and apertures 112, the nozzle whips around in a somewhat violent fashion when high pressure air is delivered to the nozzle 76 through the hose 74. As the nozzle and hose end whip around, the leading surface 116 of the nozzle 76 dislodges debris from the interior surfaces of the duct walls 58. The nozzle 76 closely approaches, but does not normally strike, the duct walls 58. This is accomplished by selecting an angle $\phi$ sufficiently large (e.g., 45°) that the jets 114 repel the nozzle 76 from the walls 58 when the nozzle approaches.

During agitation with the air nozzle 76, the HVAC unit 30, by normal operation, imparts a negative pressure in the ductwork lumen 56, causing net air movement (with suspended debris) through the ductwork toward the HVAC unit. Also during the agitating, a rigid borescope 50 is inserted through the same opening as the hose 74 so that the operator can monitor progress of the cleaning.

All branch ducts from the main return ductwork are likewise cleaned, working from the distal end toward the HVAC unit 30. As the HVAC unit 30 draws the debris-laden air toward it, the installed filter 70 traps the debris as the air passes through the filter into the HVAC unit. If the ductwork contains a heavy build-up of debris, a portable vacuum may be used to collect the bulk of the debris to prevent overloading the filter 70 at the HVAC unit 30.

After the high-pressure air cleaning is completed, the ducts may be reinspected as necessary. After turning the HVAC unit off, the debris-laden filter may be removed therefrom. After cleaning, the return ductwork 10 may then be disinfected again, if desired, using the fogger. As in an earlier step, such fogging is performed starting at the distal inlet registers and working toward the HVAC unit 30. A fogger may also be used to inject into the ductwork a sealant chemical such as calcium chlorohydrate solution. After drying, the sealant eliminates small leaks that may otherwise be present, for example, where duct sections are joined together. After disinfection and sealing, the return ductwork may be again inspected if desired.

After the return ductwork 10 is cleaned, the supply ductwork 20 is cleaned. First, if required, small access holes 44–46 are cut in the supply ducts 20. Each access hole is covered with a plug or cover plate. Next, the HVAC unit 30 is turned off and, if preliminary disinfection of the return ductwork is indicated, the disinfectant fogger is connected to a trunk supply duct upstream of the duct to be cleaned but downstream of the HVAC unit blower.

To begin the procedure, filter medium 62 should be installed in or over each diffuser or outlet register 66 connected to the supply ducts 2 to be cleaned. Before applying the disinfectant, the supply ducts 20 may be inspected using the fiber-optics borescope 50, starting nearest the HVAC unit 30 and working toward the most distal diffusers 66 in the supply duct to be cleaned. After inspection is complete, the disinfectant fogger is turned on to inject disinfectant aerosol into the downstream supply ductwork 20. The disinfectant should be allowed to contact the interior surfaces of the ductwork 20 for a time sufficient to achieve satisfactory kill of the biological growth thereon.

To begin the cleaning step, a portable blower/filter unit 84 is connected to the distal diffuser on the supply duct to be cleaned and turned on. The HVAC unit 30 is also turned on. A high pressure high velocity air hose 74 supplied by a portable air compressor 72 is inserted into the supply duct to be cleaned, starting at the portion thereof nearest the HVAC unit 30 and working toward the blower/filter unit 84. As the air hose is threaded into the supply duct trunk line, accumulated debris is dislodged from the interior surfaces of the duct and carried toward the blower/filter unit 84 which traps the debris on a large filter as the blower/filter unit draws the air through the filter. To monitor progress, a borescope is positioned in the same opening as the hose. To clean ducts that branch from the trunk line; the blower/filter unit 84 is connected to the distal register of the branch line before the air hose 74 is inserted into the branch line at an upstream location.

After all the supply ducts are clean, they may be reinspected, if desired, using the fiber-optics borescope 50 in the same manner as previously. The blower/filter unit 84 is then disconnected from the ductwork. If desired, the cleaned ductwork may be disinfected again as previously. Also, the return ductwork 10 may be chemically sealed in the same manner as the supply ductwork 20.

Upon completing the above procedures, the filters 62 are removed from the diffusers 66. If desired, the diffusers 66 may be cleaned by any of several methods in common practice. A thorough cleaning of the entire HVAC system in a building also includes a cleaning of the HVAC unit, which may be performed via any of several known methods in current practice.

As can be seen in this example, the entire HVAC ductwork in a building may be cleaned and disinfected via a procedure that is simple and convenient to perform and which causes minimal disruption of normal activity in the building. Also, the method of the present invention may be performed in high-rise buildings on any floor because the method is not dependent upon the use of a truck-mounted vacuum unit. Further, the method of the present invention utilizes the air-moving capability of the HVAC unit during part of the cleaning procedure, minimizing the need to connect bulky equipment to the ductwork. Finally, the method of the present invention includes at least one step whereby the interior walls of the ductwork are inspected, permitting the operator to determine which areas require more intensive cleaning and to assess the effectiveness of the cleaning procedure.

Having illustrated and described the principles of my invention in a preferred embodiment and variations thereof, it should be apparent to those skilled in the art that the invention may be modified in arrangement and detail without departing from the principles thereof. I claim as my invention all modifications coming within the scope and spirit of the following claims.

I claim:

1. A method of cleaning accumulated debris from the interior surfaces of HVAC ductwork in a building without having to disassemble the ductwork, the method comprising:

installing a particle filter substantially transversely across the lumen of the ductwork downstream of the portion of the ductwork to be cleaned;

agitating the accumulated debris on the interior surfaces of the ductwork such that the debris becomes detached from the underlying interior surface of the ductwork, thereby causing the debris to become suspended in air in the lumen of the ductwork; and moving the air containing suspended debris through the ductwork toward the filter, passing the air through the filter and capturing the debris on the filter.

2. The method of claim 1 including the step of illuminating and visually inspecting the interior surfaces of the ductwork, using a borescope, during the agitating.

3. The method of claim 1 further comprising injecting disinfectant into the lumen of the ductwork as an aerosol.

4. The method of claim 3 wherein the disinfectant is allowed to contact the interior surfaces of the ductwork for a time sufficient to kill substantially all the biological growth present on the interior surfaces of the ductwork within the portion of the ductwork to be cleaned before beginning the step of agitating the debris.

5. The method of claim 1 wherein accumulated debris is agitated and detached from the interior surfaces of the ductwork to be cleaned using a high-velocity air jet impingingly directed toward the interior surface of the duct.

6. The method of claim 5 wherein the high-velocity air jet is delivered from a nozzle on the terminus of a flexible hose, the hose and nozzle threaded into the duct from an available opening in the duct and urged down the lumen of the duct, and the air supplied by a portable air compressor connected to the opposite terminus of the hose.

7. The method of claim 6 wherein the jet extends back along the hose at an acute angle to the axis of the hose at the location of attachment.

8. The method of claim 1 including the step of installing a particle filter across each opening of the ductwork to be cleaned, for the purpose of preventing the unintended escape of disinfectant aerosol and debris-laden air from the ductwork during subsequent disinfection and removal of debris from the ductwork.

9. The method of claim 1 as used to clean return ductwork, wherein:

the particle filter is installed across the lumen of the return ductwork downstream of the portion of the return ductwork to be cleaned and between the portion of the return ductwork to be cleaned and the HVAC unit; and the blower in the HVAC unit, by causing a reduction of air pressure in the return ductwork when the blower is operating, is employed for moving air containing suspended debris through the return ductwork toward the particle filter, passing the air through the filter, and capturing the debris on the filter.

10. The method of claim 1 as used to clean supply ductwork, wherein:

the particle filter is installed across the lumen of the supply ductwork downstream of the portion of the supply ductwork to be cleaned;

a portable blower is connected to an opening in the supply ductwork downstream of the portion of the supply ductwork to be cleaned; and the portable blower, by causing a reduction of air pressure in the supply ductwork to be cleaned when the portable blower is operating, is employed for moving air containing suspended debris through the supply ductwork toward the particle filter, passing the air through the filter, and capturing the debris on the filter.

11. The method of claim 1 wherein all return ductwork of an HVAC system is cleaned before supply ductwork of the system is cleaned.

12. The method of claim 1 including the step of disinfecting the interior surfaces of the ductwork after removing the accumulated debris from said interior surfaces.

13. The method of claim 1 including the step of sealing the ductwork after cleaning using an appropriate chemical sealant.

14. The method of claim 13 wherein the chemical sealant is injected into the ductwork as an aerosol.

15. A method of cleaning accumulated debris from the interior surfaces of HVAC ductwork in a building without having to disassemble the ductwork, the method comprising:

partially inserting a hose, having a nozzle at its free end, through an opening into the ductwork; and supplying pressurized air to the hose such that the nozzle and hose whip around inside the ductwork to agitate the accumulated debris on the interior surface of the ductwork such that the debris becomes detached from the interior surface of the ductwork.

16. The method of claim 15 further comprising visually inspecting the interior surface of the ductwork during the agitating by viewing through a borescope inserted through the same opening as the hose.

17. An apparatus for cleaning the debris from the interior surfaces of HVAC ductwork, the apparatus comprising:

a source of pressurized air;

a flexible hose having one end attached to the air source; and a nozzle attached to the other end of the hose, the nozzle having apertures positioned such that when the source is supplying air to the hose, the nozzle end of the nozzle is accelerated so that the hose whips around.

18. The apparatus of claim 17 wherein the nozzle has a plurality of apertures that partially reverse the direction of air flow so that air jets extend radially from the axis of the hose and extend back along the hose at an acute angle to the axis of the hose.

* * * * *